US008146279B2

(12) United States Patent
Elmer

(10) Patent No.: US 8,146,279 B2
(45) Date of Patent: Apr. 3, 2012

(54) ADVERTISING SIGN AND METHOD

(76) Inventor: Steve W. Elmer, Winter Park, FL (US)

( * ) Notice: Subject to any disclaimer, the term of this patent is extended or adjusted under 35 U.S.C. 154(b) by 288 days.

(21) Appl. No.: 12/261,619

(22) Filed: Oct. 30, 2008

(65) Prior Publication Data

US 2009/0107019 A1 Apr. 30, 2009

Related U.S. Application Data

(60) Provisional application No. 60/984,114, filed on Oct. 31, 2007.

(51) Int. Cl.
*G09F 21/04* (2006.01)

(52) U.S. Cl. ..... 40/600; 40/592

(58) Field of Classification Search ..... 40/592, 40/600

See application file for complete search history.

(56) References Cited

U.S. PATENT DOCUMENTS

| | | | | |
|---|---|---|---|---|
| 914,775 | A | 3/1909 | Aarons | 40/597 |
| 1,359,492 | A | 11/1920 | Demuth | 40/606 |
| 2,675,983 | A | 4/1954 | King | 40/591 |
| 2,816,377 | A | 12/1957 | Hastings | 40/591 |
| 2,960,786 | A | 11/1960 | Wagner | 40/592 |
| 3,153,294 | A | 10/1964 | Hay et al. | 40/592 |
| 3,245,165 | A | 4/1966 | Podoloff | 40/600 |
| 3,284,938 | A | 11/1966 | Diehl et al. | 40/610 |
| 3,507,245 | A | 4/1970 | Grabow | 40/592 |
| 3,715,821 | A | 2/1973 | Hawes | 40/591 |
| 3,828,455 | A | 8/1974 | Bentley | 40/602 |
| 4,052,806 | A | 10/1977 | George | 40/572 |
| 4,231,501 | A | 11/1980 | Goode | 224/42.46 |
| 4,587,754 | A | 5/1986 | Ossner | 40/564 |
| 4,667,428 | A | 5/1987 | Elmer | 40/597 |
| 4,671,004 | A | 6/1987 | Berg | 40/592 |
| 4,976,410 | A | 12/1990 | Tomaiuolo | 40/591 |
| 4,995,186 | A | 2/1991 | Collie | 40/591 |
| 5,084,994 | A | 2/1992 | Elmer | 40/602 |
| 5,323,728 | A | 6/1994 | Hjelm | 40/600 |
| 5,711,100 | A | 1/1998 | Elmer | 40/592 |
| 5,787,622 | A * | 8/1998 | Green et al. | 40/621 |
| 5,918,397 | A * | 7/1999 | Elmer | 40/592 |
| 6,868,630 | B2 * | 3/2005 | Kim | 40/711 |
| 7,155,851 | B2 * | 1/2007 | Ootsuka | 40/622 |

FOREIGN PATENT DOCUMENTS

| | | |
|---|---|---|
| CA | 2041396 | 10/1992 |
| GB | 2 124 008 | 2/1984 |

* cited by examiner

*Primary Examiner* — Joanne Silbermann

(74) *Attorney, Agent, or Firm* — Allen, Dyer, Doppelt, Milbrath & Gilchrist, P.A.

(57) ABSTRACT

An advertising sign includes an advertising element having a base, mounting means pivotably connected to the base for securing the advertising sign to a mounting surface, and at least one protrusion extending between the base and the mounting means such that a range of pivotal motion of the mounting means relative to the base is more limited in an area of the protrusion than in other areas.

11 Claims, 4 Drawing Sheets

ADVERTISING SIGN AND METHOD

CROSS-REFERENCE TO RELATED APPLICATION

This application claims the benefit of U.S. Provisional Application Ser. No. 60/984,114, filed on Oct. 21, 2007, the contents of which are hereby incorporated by reference in their entirety.

FIELD OF THE INVENTION

The present invention relates to advertising signs, and particularly, to vehicle advertising signs that for releasably securing to vehicles.

BACKGROUND OF THE INVENTION

Removably mounted vehicle advertising signs are used in many industrial and commercial enterprises, particularly where employees' personal vehicles are used in connection with the enterprise. For example, many pizzerias require drivers to use their own vehicles when making deliveries. In such instances, it is desirable that the vehicle display advertising when used in connection with the enterprise, but not display advertising when in personal use.

Examples of removably mounted advertising signs are disclosed by U.S. Pat. Nos. 5,918,397 and 5,711,100, the contents of which are hereby incorporated by reference in their entirety. In such advertising signs, magnets are mounted to the base of the signs in such a manner that the magnets are pivotable to adjust to differences in slope along a vehicle surface, so as to enable secure mounting of the advertising signs to multiple vehicle makes and models.

SUMMARY OF THE INVENTION

It is an object of the present invention to provide an advertising sign for releasable securing to a vehicle or other surface and an associated method, which enables releasable securing of the advertising sign, while improving the ease and safety with which the sign is removed.

According to an embodiment of the present invention, an advertising sign includes an advertising element having a base, the base having at least one mounting point adapted to pivotably mount at least one mounting means for securing the advertising element to a mounting surface. In the area of the at least one mounting point, the base is configured to limit a range of pivotal motion of the mounting means relative to the base more in one direction than in other directions.

According to another embodiment of the present invention, a vehicle advertising sign includes an advertising element having a base, a plurality of magnet assemblies pivotably mounted to the base such that the sign can be releasably secured to a curved vehicle surface, and a plurality of protrusions extending between the base and the magnet assemblies such that a range of pivotal motion of the magnet assemblies relative to the base is more limited in areas of the protrusions than in other areas.

According to another aspect of the present invention, the base includes at least one foot, the mounting means being attached to the at least one foot. According to a further aspect of the present invention, a recess is defined within the at least one foot, the mounting means is at least partially accommodated within the recess, and the protrusion is located within the recess.

According to an additional aspect of the present invention, the mounting means is attached in at least one corner of the base, and the protrusion is located proximate to the apex of the at least one corner.

According to another embodiment of the present invention, a method of removing a vehicle advertising sign from a vehicle surface includes gripping the vehicle advertising sign at a location along an edge of a base thereof, pulling the edge away from the vehicle surface to release mounting means proximate to the gripped location and pivot mounting means more remote from the gripped edge, contacting the more remote mounting means with at least one protrusion extending between the base and the mounting means, and fully removing the advertising sign by continuing to pull the edge away from the vehicle surface, thereby leveraging the more remote mounting means out of contact with the vehicle surface.

These and other objects, advantages and features of the present invention will be better understood in light of the drawings and detailed description of preferred embodiments.

DETAILED DESCRIPTION OF PREFERRED EMBODIMENTS

Figure 1:
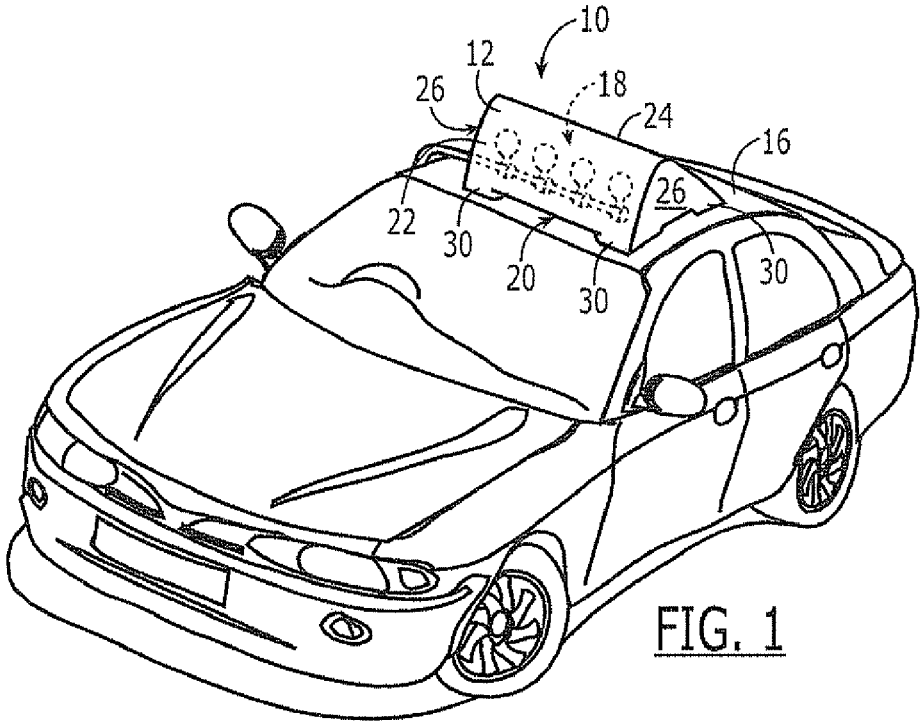
FIG. 1 is a perspective view of a vehicle advertising sign, including a vehicle surface to which the advertising sign is mounted, according to an embodiment of the present invention.
Figure 2:
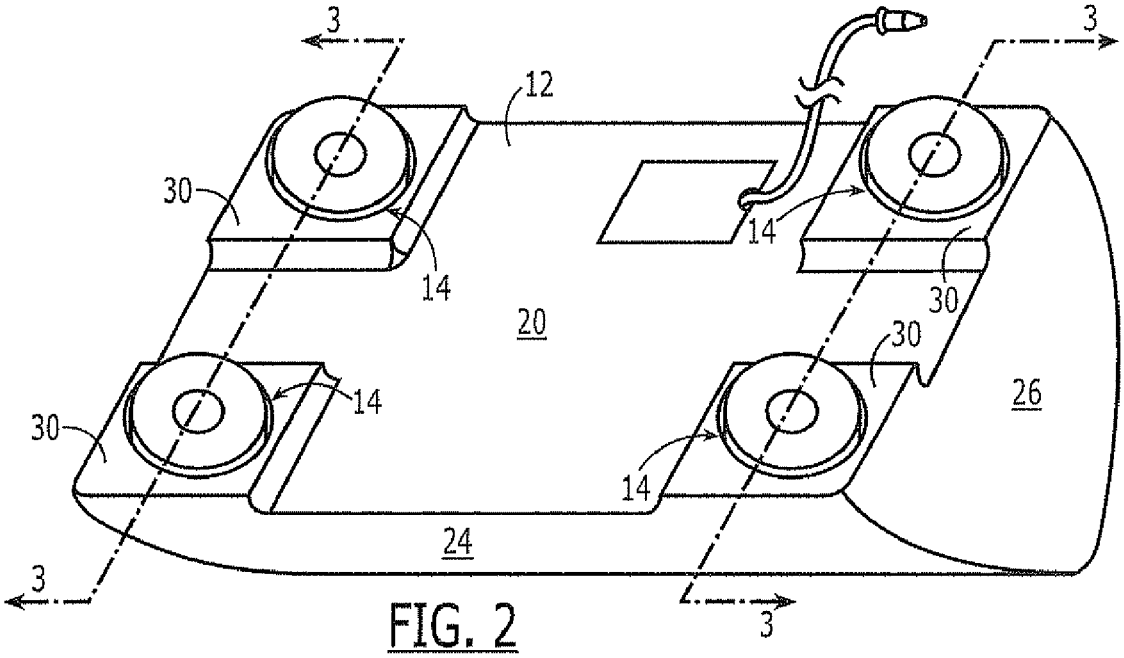
FIG. 2 is another perspective view of the vehicle advertising sign of FIG. 1.

Referring to FIGS. 1 and 2, a vehicle advertising sign 10 includes an integrally molded advertising element 12 defining a substantially enclosed interior. A plurality of magnet assemblies 14 are attached to the advertising element 12, and serve as mounting means for releasably securing the vehicle advertising sign 10 to a vehicle surface 16. An illuminating lamp assembly 18 is arranged within the interior of the advertising element 12. The advertising element 12 has a base 20, a front surface 22, a rear surface 24, and generally opposed side surfaces 26. The base 20 is formed with a plurality of feet 30, each foot 30 being located at a corner of the base 20.

Figure 3:
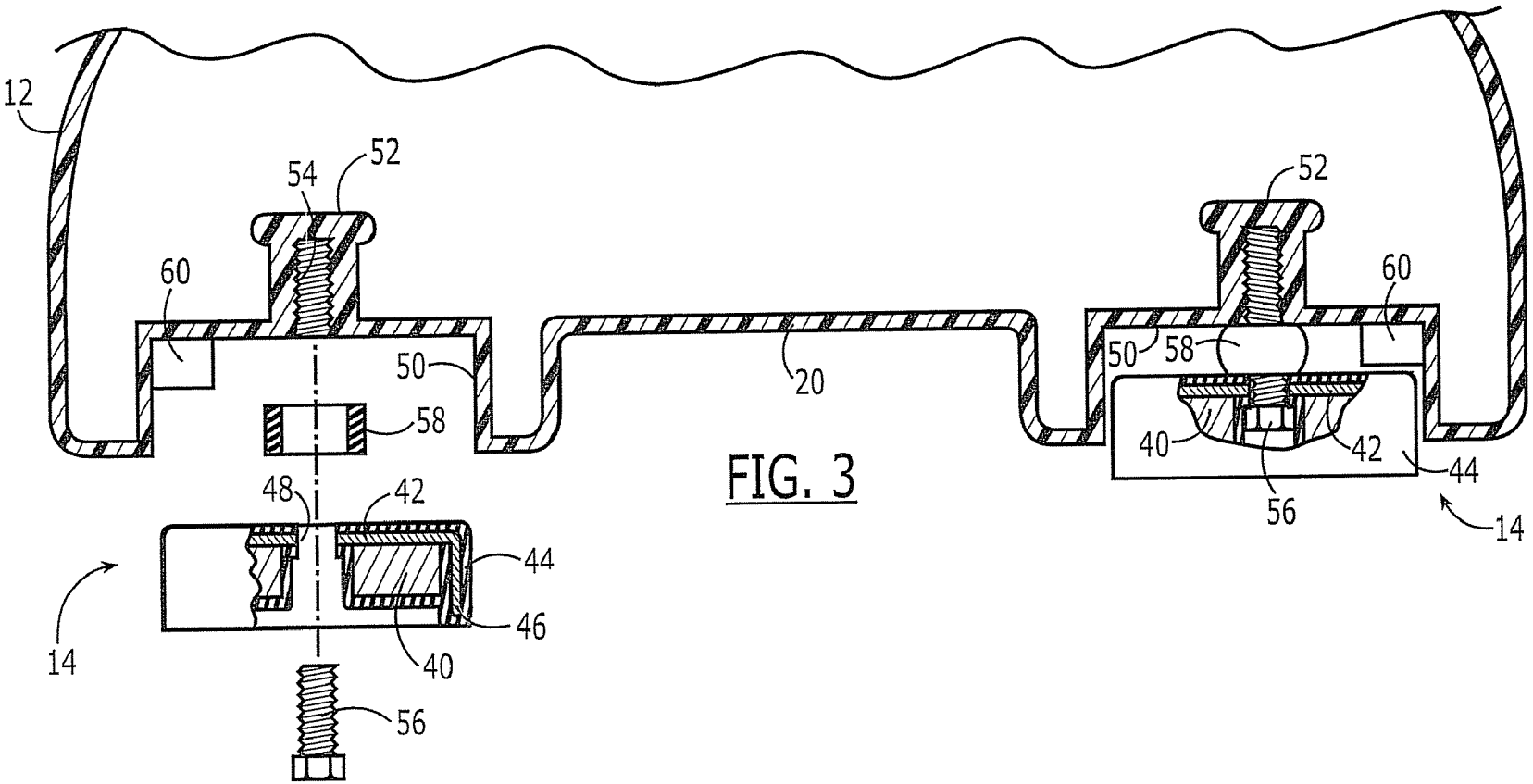
FIG. 3 is a sectional view of a portion of an advertising element taken along line 3-3 of FIG. 2, including exploded and partially cut-away views of magnet assemblies.

Referring to FIG. 3, each magnet assembly 14 includes a magnet 40 arranged within a metal housing 42. The magnet 40 and metal housing 42 are both covered in a plastic coating 44. The metal housing 42 has a lip 46 that extends past a lower surface of the magnet 40. A central opening 48 is formed through the magnet 40 and metal housing 42.

Each foot 30 has a recess 50 defined therein, each recess 50 extending into the interior of the advertising element 12 and serving as a receptacle for a corresponding magnet assembly 14. A molded extension 52, defining a threaded bore 54, extends further into the advertising element 12 from an upper surface of the recess 50, and serves as a mounting point for the magnet assembly 14.

Attachment means for securing the magnet assembly 14 to the advertising element 12 include a screw 56 and a flexible sleeve 58. The screw 56 is inserted through the central opening 48 of the magnet assembly 14 and threaded into the threaded bore 54. The flexible sleeve 58 is arranged around the screw 56 between the magnet assembly 14 and the upper surface of the recess 50. The flexible sleeve 58 establishes an offset between an upper surface of the magnet assembly 14 and the upper surface of the recess 50, such that at least a portion of the magnet assembly 14 extends out of the recess 50. A protrusion 60 is arranged within each recess 50. As best appreciated in FIG. 4, the protrusion 60 is located along an edge of the recess 50 most proximate to the apex 62 of the corresponding corner of the base 20.

Figure 5:
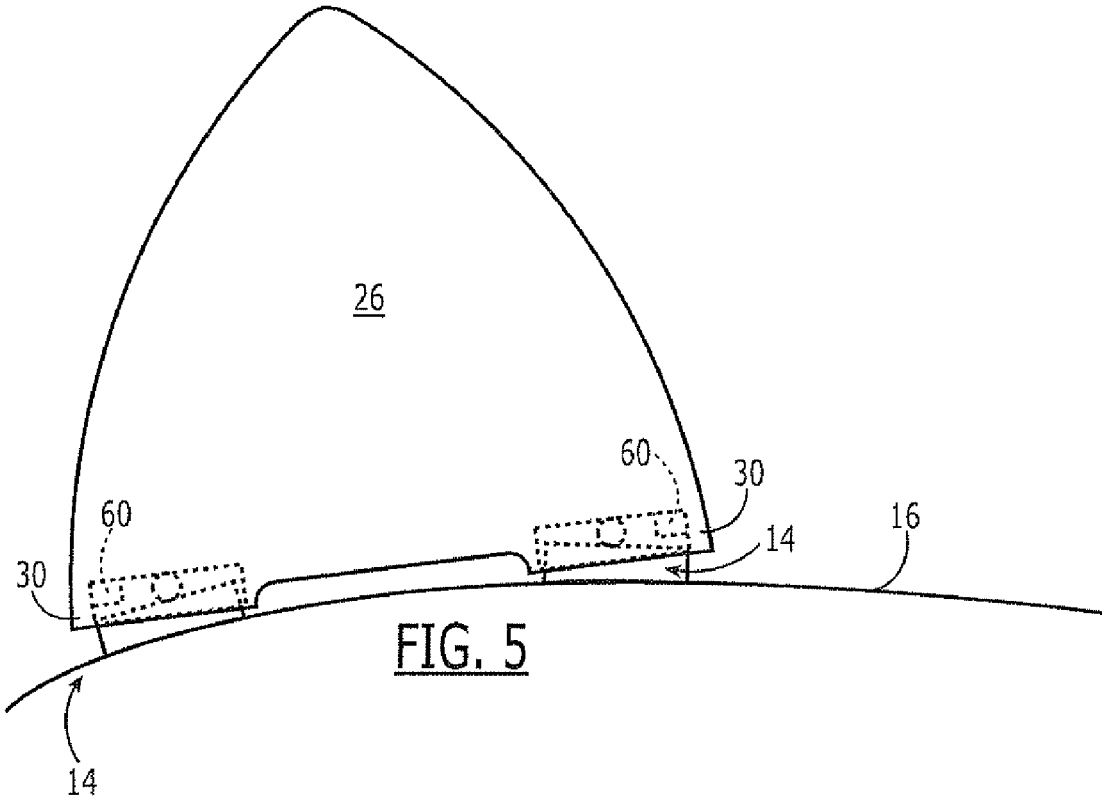
FIG. 5 is a schematic side view of the vehicle advertising sign of FIG. 1, showing the vehicle advertising sign in a mounted state.

Referring to FIG. 5, in the method of the present invention, the advertising sign 10 is positioned over and then placed on the vehicle surface 16. The magnet assemblies 14 magnetically mate with the vehicle surface 16. The screw 56 and flexible sleeve 58 allow each magnet assembly 14 to pivot to a limited degree within the offset between the upper surfaces of the magnet assembly 14 and the recess 50. Accordingly, the magnet assemblies 14 pivot to adjust to the curvature of the vehicle surface 16 and ensure secure mounting by allowing for an optimal alignment between the magnet 40 and the vehicle surface 16. The plastic coating 44 prevents abrasion of the vehicle surface 16 by each magnet assembly 14. The lip 46 of the metal housing 42 prevents direct contact between each magnet 40 and the vehicle surface 16, which facilitates subsequent removal.

Figure 6:
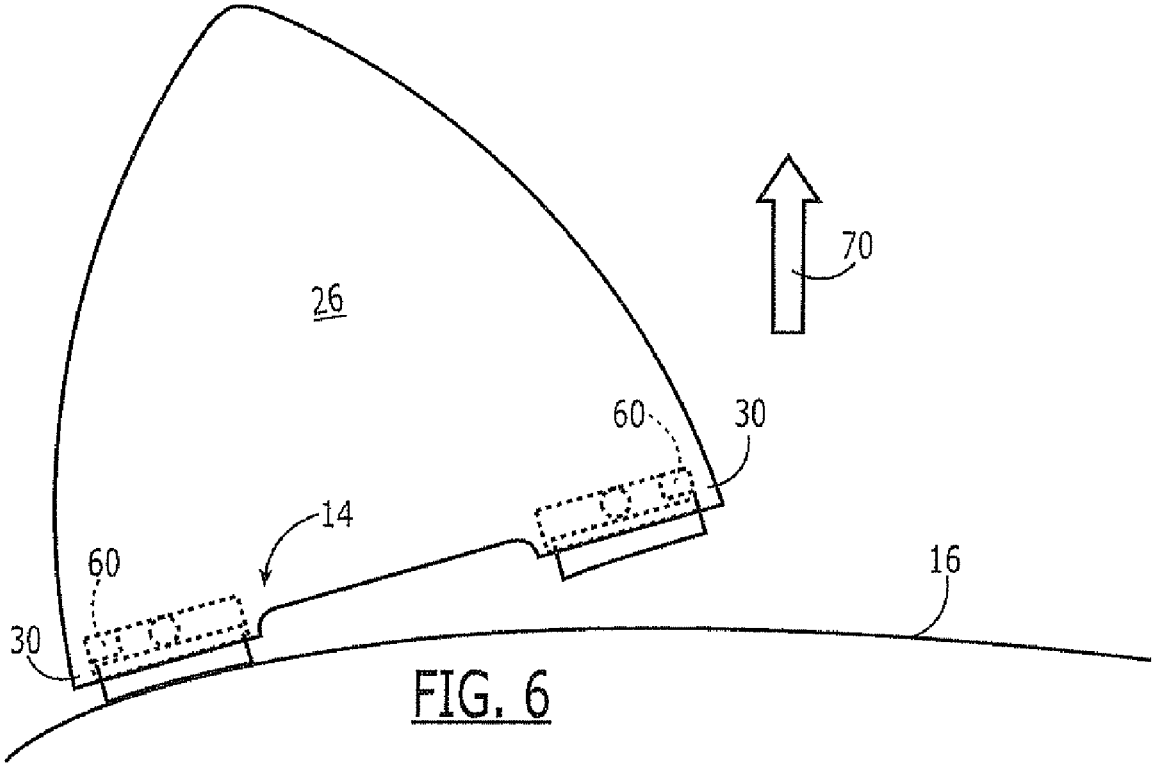
FIG. 6 is a schematic side view of the vehicle advertising sign of FIG. 1, showing the vehicle advertising sign during removal.

Referring to FIG. 6, subsequent removal of the vehicle advertising sign 10 is accomplished by gripping the sign along an edge of the base 20 between adjacent feet 30 (for example, between the feet 30 along the edge between the base 20 and rear surface 24) and pulling away from the vehicle surface 16, as generally indicated by the arrow 70. The magnet assemblies 14 along the edge of the base 20 that is gripped will then release from the vehicle surface 16, while the magnet assemblies 14 along the opposing edge of the base 20 will initially pivot within the recesses 50 of the corresponding feet 30 and temporarily remain aligned with and mated to the vehicle surface 16.

The upper surface of the magnet assemblies 14 along the opposite edge of the base 20 will then contact the corresponding protrusions 60, further limiting the degree to which the magnet assemblies 14 can pivot. This engagement improves the leverage that can be applied to release the magnet assemblies 14, further facilitating release of the magnet assemblies 14 and complete removal of the vehicle advertising sign 10.

Those skilled in the art will appreciate that the present invention is not limited to the embodiment herein shown and described, but that various modifications, and adaptations for particular circumstances, are possible within the scope of the present invention.

For example, directional terms used herein, such as upper, lower, front, rear and side, refer to the ordinary orientation of a vehicle advertising sign when mounted on the roof of a vehicle. Such directional terms are used for illustrative purposes, and do not limit the present invention to any particular mounting alignment or geometry. "Advertising" refers generically to any visible symbol or indicia, and is not necessarily limited to commercial advertising.

Also, in this application, "releasable" refers to the ability to be secured and removed from a surface without making or breaking a mechanical joint. An advantageous example of a releasable mounting means is the magnet assembly shown herein, but other releasable mounting means can be employed in connection with the present invention. For example, vacuum or suction mounting devices could be employed. The magnet assemblies, themselves, are also not limited to the magnet assemblies shown and disclosed. For example, the metal housing and plastic coating could be replaced or omitted. The present invention can also include advertising elements to which mounting means have not yet been attached.

Additionally, the advertising element shown herein, with sloped front and rear surfaces and generally triangular side surfaces, is advantageous both aerodynamically and for advertising purposes. However, the present invention is not necessarily limited to an advertising element of any particular shape or dimensions. For example, an advertising element with a triangular or circular base could be also be used. Other, non-exclusive examples of other designs for advertising signs and elements suitable for use in connection with the present invention are disclosed by U.S. Pat. Nos. D447,774, D433,454 and D429,766, the contents of which are hereby incorporated by reference in their entirety.

Similarly, an integrally molded advertising element is advantageous for ease of fabrication and imperviousness to the elements. However, the present invention is not necessarily limited to an integrally molded advertising element, nor to an advertising element formed of any particular material(s).

Also, the vehicle advertising sign shown herein includes an illuminating lamp assembly arranged with an advertising element. The present invention does not necessarily require an illuminating lamp assembly and is not necessarily limited to any particular design or type of illuminating lamp assembly.

Additionally, the base of the present invention is shown having molded feet in which recesses forming receptacles for magnet assemblies are defined. The present invention is not necessarily limited to such an embodiment. For example, molded feet could be omitted and the recesses formed within a substantially flat base, or recesses and/or feet could be omitted and the mounting means could be attached directly to the base. Also, other attachment means for securing the mounting means to the advertising element could be used besides the flexible sleeve and screw shown and disclosed herein, while still permitting pivotal motion between the mounting means and the advertising element.

Figure 4:
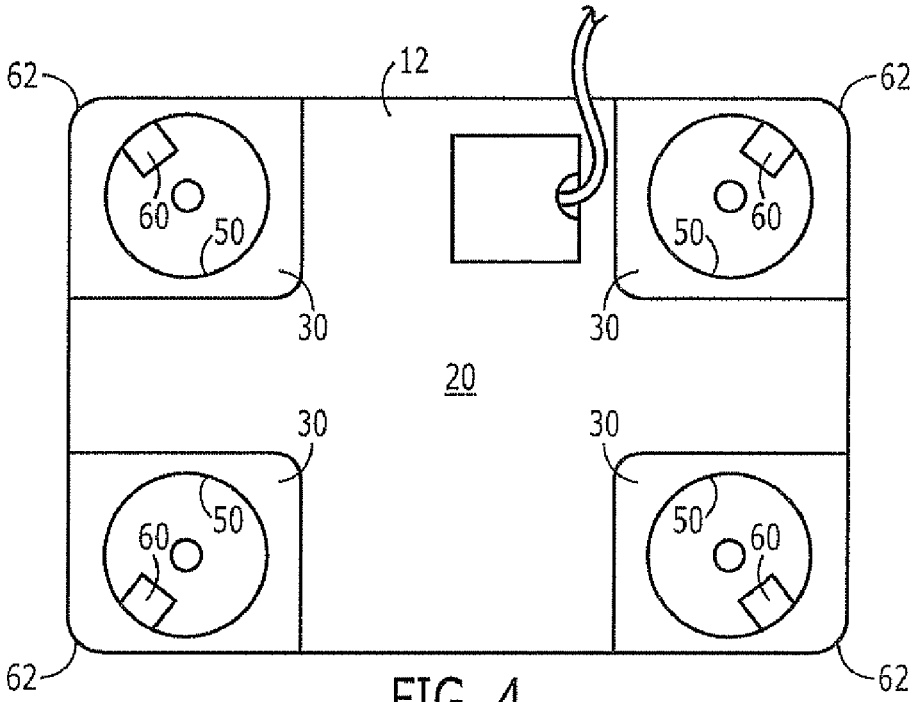
FIG. 4 is a bottom view of the vehicle advertising sign of FIG. 1, with the magnet assemblies removed to show details.

Furthermore, the protrusions are not necessarily limited to a particular shape, design or placement relative to the corresponding mounting means, as long as the protrusion is capable of contacting, and further limiting the pivotal motion of, the mounting means. However, the placement of the protrusions 60 proximate to an apex 62 of each corner of the base 20 (as best seen in FIG. 4) is advantageous in that, regardless of the edge or corner or the advertising element 12 that is initially pulled upward to remove the advertising sign 10, the protrusion(s) 60 corresponding to the opposing mounting means will still limit the pivotal motion of the opposing mounting means during removal of the advertising sign 10.

Since the large majority of vehicle surfaces to which the advertising sign would likely be mounted have a generally convex shape, adjacent feet will typically pivot towards each other when the advertising sign is mounted. Accordingly, it is also preferred that that protrusions not be located so as to inhibit such pivoting, which is another advantage of locating the protrusions proximate to the apex of each corner of the base. In an advertising element with a circular base, similar advantages are achieved by locating the protrusions more proximate to the circumference of the base than to the center.

Figure 7:
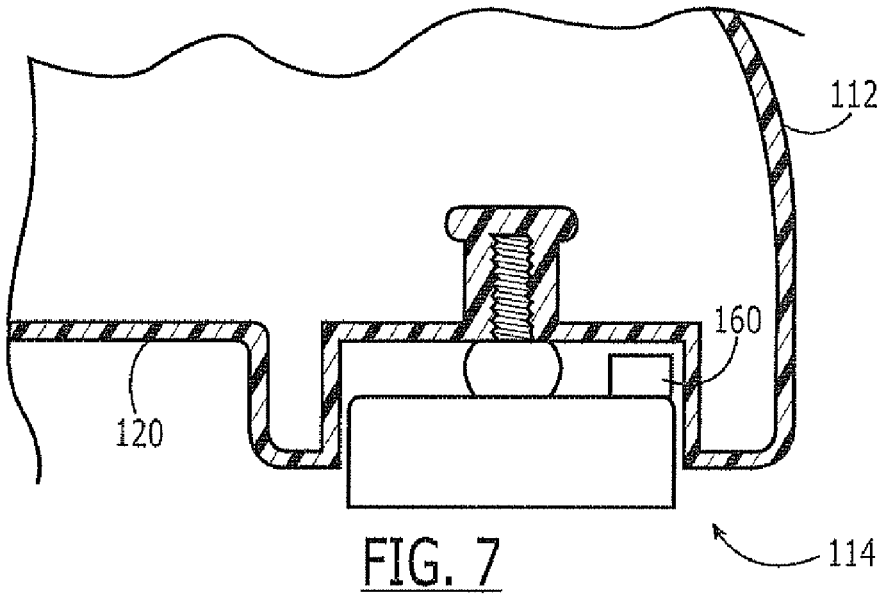
FIG. 7 is a sectional view of a portion of an advertising element, including a side view of a magnet assembly, according to another embodiment of the present invention.

Additionally, the protrusions can be integrally molded with the base or manufactured as separate inserts that are then attached to the base, either during initial manufacturing of the advertising sign or at a later date. For the instance, the present invention includes advertising signs retrofitted to include protrusions. Moreover, it is advantageous to locate the protrusions on the base, since their location is then readily fixed with regards to the edges and corners of the base. However, the protrusions could also be located on the mounting means. For example, referring to FIG. 7, an advertising element 112 has a magnet assembly 114 attached to a base 120 thereof. Rather than being located on the base 120, a protrusion 160 is located on the magnet assembly 114.

Also, the present invention is not necessarily limited to a particular shape or design of protrusion. For instance, although the protrusions shown herein are easily molded or inserted, it is not necessary that the protrusion create a step discontinuity with adjacent surfaces. The terms "extending between" do not necessarily mean extending completely between.

Those skilled in the art will appreciate that the foregoing is not an exhaustive list of modifications, but that these and other modifications, adaptations, and variations come within the scope of the present invention, as herein shown and described

What is claimed is:

1. A vehicle advertising sign comprising:

an advertising element having a base, the base having at least one mounting point adapted to pivotably mount at least one mounting means for securing the advertising element to a vehicle mounting surface;

wherein, in the area of the at least one mounting point, the base is configured to limit a range of pivotal motion of the mounting means relative to the base more in one direction than in other directions; and wherein the base includes a plurality of corners, the at least one mounting point includes a plurality of mounting points and the base is configured to limit the range of pivotal motion of the mounting means relative to the base towards apexes of the corners than in other directions.

2. The sign of claim 1, further comprising the mounting means pivotably mounted to the base in each of the plurality of corners.

3. The sign of claim 1, wherein the base is configured with at least one protrusion in each of the corners that limits the range of pivotal motion of the mounting means in each corner relative to the base more in the direction of the the apex of each corner than in other directions.

4. The sign of claim 3, wherein at least one recess is defined in each of the corners of the base for accommodating the mounting means and each protrusion is located in a respective one of the recesses.

5. The sign of claim 4, wherein the base includes at least one foot extending from each of the corners thereof and each recess is defined in a respective one of the feet.

6. The sign of claim 3, wherein the base includes at least one foot extending from each of the corners thereof and the at least one each protrusion is located on a respective one of the feet.

7. A vehicle advertising sign comprising:

an advertising element having a base;

a plurality of magnet assemblies pivotably mounted to the base such that the sign can be releasably secured to a curved vehicle surface;

a plurality of protrusions extending between the base and the magnet assemblies such that a range of pivotal motion of the magnet assemblies relative to the base is more limited in areas of the protrusions than in other areas.

8. The sign of claim 7, wherein the protrusions are located on the base.

9. The sign of claim 7, wherein base includes a plurality of corners and edges and the protrusions are arranged such that, regardless of the edge or corner of the base that is initially pulled upward when removing the advertising sign from a vehicle surface, the protrusions associated with magnet assemblies along opposite edges or corners of the base will limit the pivot motion thereof.

10. The sign of claim 9, wherein the protrusions associated with magnet assemblies along opposite edges or corners of the base will limit the pivot motion thereof before the opposite edges or corners impact the vehicle surface.

11. The sign of claim 7, wherein the protrusions are arranged so as not interfere with pivotal motion of the magnet assemblies when the advertising sign is secured to a convexly-curved vehicle surface.

* * * * *